United States Patent [19]

Lee

[11] 4,159,631

[45] Jul. 3, 1979

[54] PERFUMED VAPOR DISPENSING JEWELRY

[76] Inventor: Ki S. Lee, 1010 Fanshawe St., Philadelphia, Pa. 19111

[21] Appl. No.: 911,490

[22] Filed: Jun. 1, 1978

[51] Int. Cl.[2] ..... A61L 9/04

[52] U.S. Cl. ..... 63/1 R; 239/36; 63/DIG. 2

[58] Field of Search ..... 239/36, 47, 39, 55, 239/44; 63/14, 1, DIG. 2

[56] References Cited

U.S. PATENT DOCUMENTS

| | | | |
|---|---|---|---|
| 168,972 | 10/1875 | Dayton | 63/DIG. 2 |
| 2,556,608 | 6/1951 | Will | 239/40 |
| 3,587,968 | 6/1971 | Hennart | 239/47 |
| 3,270,525 | 9/1966 | Sellers | 63/1 |
| 2,740,662 | 4/1956 | Scott | 239/36 |
| 2,572,329 | 10/1951 | Foster | 239/45 |
| 2,564,860 | 8/1951 | Ryberg | 239/55 |
| 2,550,828 | 5/1951 | Lawson | 63/14 |
| 2,109,092 | 2/1978 | Roll | 239/36 |
| 2,058,274 | 10/1936 | Vivandon | 63/14 |
| 1,267,063 | 5/1918 | Flagg | 63/14 |
| 644,156 | 2/1900 | Blake | 239/45 |

*Primary Examiner*—James B. Marbert
*Attorney, Agent, or Firm*—Roylance, Abrams, Berdo & Farley

[57] ABSTRACT

An article of jewelry comprises a hollow spherical housing having upper and lower halves secured together, a disc having gauze-filled cutouts formed therein, internal annular flanges supporting the disc in the housing, and wicks extending between sections of gauze and into the lower half containing perfume. A plurality of orifices in the upper half permit the perfumed vapors to escape. In one embodiment, the disc has a gauze-filled central aperture, and the upper housing half has a central orifice and a coupling ring with an opening aligned with the central aperture and orifice through which a hypodermic needle is inserted to supply perfume to the lower housing half. In another embodiment, the central orifice in the upper housing half is threaded to receive a rod having a threaded portion and an end extending into the disc central aperture, which is devoid of gauze. Removal of the rod permits the lower half to be filled by an eyedropper.

10 Claims, 6 Drawing Figures

PERFUMED VAPOR DISPENSING JEWELRY

BACKGROUND OF THE INVENTION

The present invention relates to an article of jewelry for dispensing perfumed vapors. More particularly, the present invention relates to a hollow article of jewelry which is adapted to contain a quantity of perfume and dispense perfumed vapors into the atmosphere.

Known and conventional means in jewelry for dispensing perfumed vapors into the atmosphere usually comprise an absorbent pad saturated with perfume located within a cavity in the jewelry and do not have a reservoirs of liquid perfume. The devices which employ a saturated pad are not effective since the vapors are emitted in varying strengths, are emitted for only a relatively short period of time, and are incapable of being refilled and reused a relatively large number of times. The strength of the vapors emitted from these prior art devices varies because the rate of evaporation of the perfume in the saturated pad varies as the saturation of the pad varies. Since the pads may only absorb a relatively small amount of perfume, the pads will exhaust their supply of perfume and cease emitting perfumed vapors in a relatively short period of time. Upon drying out, these prior art pads become hard, lose their ability to absorb fluids and become inoperative. Typical examples are U.S. Pat. Nos. 1,267,067, Flagg; 2,058,274, Vivaudou; 2,109,092, Roll; 2,550,828, Lawson; 2,564,860, Ryberg; and 2,740,662, Scott.

U.S. Pat. No. 3,270,525 to Sellers discloses an article of jewelry which dispenses perfumed vapors comprising a hollow body in which a quantity of perfume is contained. Extremely small holes are formed in the body of the article to permit the vapors to escape. The holes are small enough in cross-sectional area to assure that the surface tension of the perfume will prevent the perfume from leaking out of the openings. This type of device is disadvantageous since the extremely small openings are expensive and difficult to manufacture due to the close tolerances required. Also, if the openings are too large, perfume will leak out of the article and evaporate at too great a rate, or if the openings are too small, they will clog easily and will not be able to emit the vapors in sufficient quantities.

The prior art has suggested the use of a reservoir of volatile liquid which is evaporated into the atmosphere through a wick and an absorbent pad. However, these prior art dispensers have not heretofore been incorporated into a piece of jewelry to produce a practical device since their construction is too complex and cumbersome, and not adaptable for jewelry. Typical examples are U.S. Pat. Nos. 644,158, Blake; 2,572,329, Foster; and 3,587,968 to Hennart.

SUMMARY OF THE INVENTION

Accordingly, it is an object of the present invention to provide an article of jewelry which will emit perfumed vapors at a predetermined and constant strength for a relatively long period of time. In particular, it is the object of the present invention to provide an article of jewelry which has a leak-proof reservoir to contain a quantity of perfume, an absorbent material from which the perfume is evaporated and wicks which feed perfume from the reservoir to the absorbent material.

Another object of the present invention is to provide an article of jewelry which will emit perfumed vapors and which is easily refillable. In particular, it is the object of the present invention to provide central openings in various parts of the jewelry through which a device may be inserted into the interior of the jewelry to refill the reservoir with perfume.

A further object of the present invention is to provide a perfumed vapor emitting article of jewelry which may be reused repeatedly without losing its effectiveness.

Yet another object of the present invention is to provide a perfumed vapor emitting article of jewelry which is inexpensive and easy to manufacture, and easy to maintain.

The foregoing objects are attained by providing an article of jewelry for dispensing perfumed vapors, wherein the combination comprises a hollow housing, a reservoir in the lower half of the housing, a disc located inside the housing, means for supporting the disc in the housing, a plurality of orifices located in the upper half of the housing through which the perfumed vapors may exit, a central orifice located in the upper half of the housing into which perfume may be introduced into the reservoir, a plurality of cutouts formed in the disc which are filled with absorbent material, and wicks extending from the absorbent material into the reservoir.

By making the housing of the article of jewelry hollow, the lower half may be employed as a reservoir which is capable of containing a substantial amount of perfume. The disc covers the reservoir to prevent leakage of the liquid perfume and to regulate the evaporation of the perfume in the absorbent material. The emission of the perfumed vapors is also controlled by the number and size of the orifices in the upper portion of the housing. Since the disc seals the reservoir against leakage of the liquid perfume contained therein, the orifices in the upper half of the housing may be made large enough to permit easy emission of the perfumed vapors and to prevent clogging thereof.

The central orifice in the housing facilitates refilling of the reservoir with liquid perfume by permitting a filling device, such as a hypodermic needle or eyedropper, to be inserted into the reservoir.

Since the device of the present invention has a large supply of liquid perfume contained therein, it will emit perfumed vapors for relatively long periods of time and will prevent the absorbent material from drying out and becoming useless.

Other objects, advantages, and salient features of the present invention will become apparent from the following detailed description, which, when taken in conjunction with the annexed drawings, discloses preferred embodiments of the present invention.

BRIEF DESCRIPTION OF THE DRAWINGS

Referring to the drawings which form a part of this original disclosure:

FIG. 6 is a side elevational view of an article of jewelry according to the present invention illustrating the general configuration of its outer surface and illustrating section line A—A along which FIGS. 1 and 5 are taken.

DETAILED DESCRIPTION OF THE INVENTION

EMBODIMENT OF FIGS. 1-3

Figure 1:
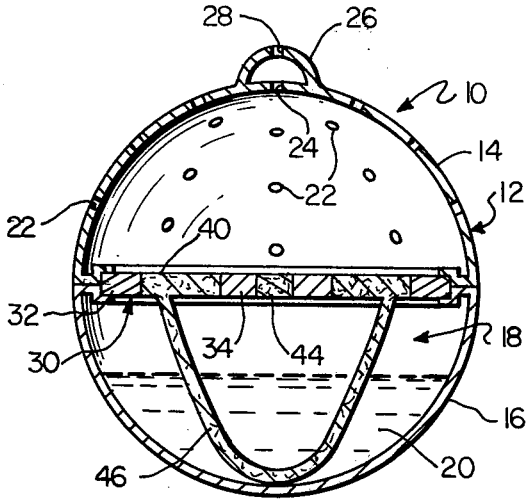
FIG. 1 is a side elevational view in longitudinal section of an article of jewelry in accordance with one embodiment of the present invention.

Referring to FIG. 1, an article of jewelry 10 has a hollow housing 12 in the form of a hollow sphere. The hollow housing 12 comprises two halves, an upper hemispherical portion or member 14 and a lower hemispherical portion or member 16 which are connected to form the spherical housing. The lower hemispherical member 16 forms a reservoir 18 on the inside thereof for receiving a quantity of liquid perfume 20. The housing may be formed by a variety of materials, including metals and plastics.

The upper hemispherical member 14 has a plurality of orifices 22 formed therethrough through which the perfumed vapors may exit the article of jewelry 10. At the uppermost portion of the housing 12 a central orifice 24 is provided. Above the central orifice 24, a ring 26 is formed as an integral part of the housing which enables the article 10 to be coupled to such other objects as necklaces, earring clasps and pins. An aperture 28 is formed in the ring 26 and is aligned with the central orifice 24.

Figure 2:
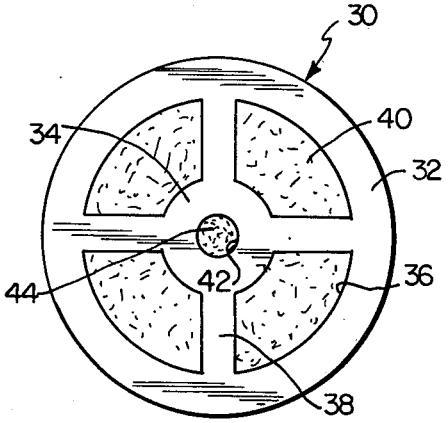
FIG. 2 is a top plan view of the disc of the embodiment shown in FIG. 1.

At the junction of the upper hemispherical member 14 and the lower hemispherical member 16, a disc 30 is supported within the housing 12. The details of the disc are shown in FIG. 2. The disc may be formed of a variety of materials, including metals and plastics. The disc 30 has an outer annular ring 32 and an inner annular ring 34 of substantially equal width in a radial direction. Between the outer ring 32 and the inner ring 34 there are four, equally sized, arcuate cutouts 36 separated by four radially extending members 38 which extend between the inner and outer rings 34, 32, respectively and which are equally spaced at 90° intervals. The cutouts 36 are at least twice as wide as the rings 32, 34 in a radial direction and are substantially trapezoidal in shape with arcuate tops and bases. Absorbent material 40, such as cotton gauze or sponge, fills the cutouts 36. The inner ring 34 has a concentric central aperture 42 which is also filled with absorbent material 44.

Referring again to FIG. 1, each section of absorbent material 40 in the disc 30 is provided with a wick 46. The wicks 46 extend downwardly from the absorbent material 40 into the lower portion of the reservoir 18 in the lower hemispherical member 16. The wicks 46 of opposed sections of absorbent material 40 may be connected as shown. The wicks 46 may be formed of the same material as the absorbent material 40. The function of the wicks 46 is to carry the liquid perfume from the lower portion of the reservoir 18 to the absorbent material 40 so that it may be evaporated into the upper portion of the housing and thereafter exited into the atmosphere through orifices 22.

Figure 3:
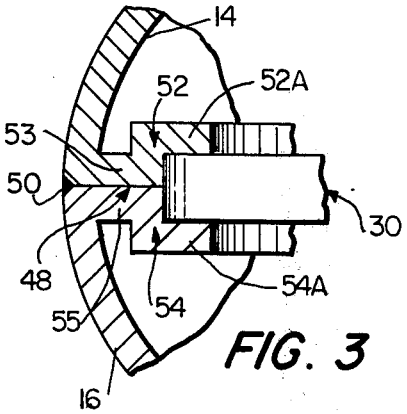
FIG. 3 is an enlarged, fragmentary cross-sectional view illustrating the details of the attachment between the housing portions and of the support means for the disc of the embodiment of FIG. 1.

FIG. 3 illustrates the connection between the hemispherical members 14, 16 and the means 48 for supporting the disc 30 at the junction of members 14, 16. The members 14, 16 are secured at their interface by a weld indicated at 50.

To support the disc 30 so that it effectively seals the reservoir 18 in the lower hemispherical member 16, member 14 has an upper L-shaped flange 52 and member 16 has a lower L-shaped flange 54. The flanges 52, 54 are annular and extend in opposite directions from radially inwardly extending edges 53, 55, respectively, on the members 14, 16. The horizontal portions 52A, 54A of flanges 52, 54 are spaced apart a distance substantially equal to the thickness of disc 30 and entrap the disc 30 therebetween when the members 14, 16 are attached.

To fill the reservoir 18 of this embodiment, the needle of a hypodermic syringe filled with liquid perfume is inserted through the axially aligned aperture 28, central orifice 24, and absorbent material 44 in center aperture 42 of disc 30. Once the point of the hypodermic needle has passed through the absorbent material 44, the perfume may then be forced into the reservoir 18 until the level of the perfume therein is just below the disc 30.

After the reservoir 18 has been filled with perfume 20, the perfume 20 will be carried up through the wicks 46 to the sections of absorbent material 40. The perfume 20 that has been absorbed into the absorbent material 40 will then evaporate into the inner volume of the upper hemispherical member 14. From there, the perfumed vapors will exit through the orifices 22 into the atmosphere adjacent the article of jewelry 10.

EMBODIMENT OF FIG. 4

Figure 4:
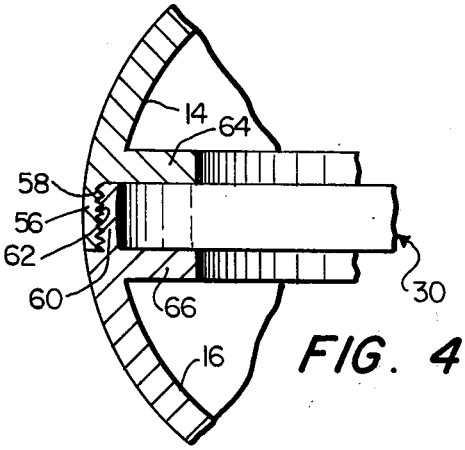
FIG. 4 is an enlarged, fragmentary cross-sectional view illustrating an alternative means for connecting the housing portions and for supporting the disc.

FIG. 4 illustrates an alternative construction for coupling the hemispheric members 14, 16 and for the means for supporting the disc 30. In this embodiment, the upper hemispherical member 14 has a depending annular flange 56 with an internal thread 58. The lower hemispherical member 16 has an upwardly extending flange 60 with an external thread 62 formed to mate with the thread 58 on flange 56. The selective engagement and disengagement of the threads 58, 62 enable the hemispherical members 14, 16 to be selectively coupled and separated.

As in the embodiment of FIGS. 1-3, the disc 30 is supported between the hemispherical members 14, 16 by a pair of inwardly extending, annular, axially spaced flanges 64, 66. The disc support flanges 64, 66 of this embodiment are not formed by bent portions of hemispherical member edges, but are formed to extend inwardly from the inner surfaces of the members 14, 16 adjacent the point at which the flanges 56, 60 extend from the hemispherical members 14, 16, respectively.

The flanges 56, 60 extend from the members 14, 16 for a distance approximately equal to or slightly less than the thickness of the disc 30 to ensure that the disc 30 will be securely entrapped between the flanges 64, 66 when the members 14, 16 are threadedly coupled to seal the reservoir 18.

Since the threaded coupling of the members 14, 16 permits them to be easily detached, the reservoir 18 of this embodiment may be filled without the use of a hypodermic needle. The reservoir 18 is filled by unscrewing the members 14, 16, removing the disc 30, and merely pouring the liquid perfume into the lower hemispherical member 16. The disc 30 used in this embodiment may be additionally provided with an upwardly extending projection (not shown) to facilitate lifting of the disc 30. The article is reassembled by placing the disc 30 on the flange 66 and screwing the members 14, 16 together. This threaded coupling of members 14, 16 also may be employed in the embodiments of FIGS. 1 and 5 to permit replacement of disc 30.

EMBODIMENT OF FIG. 5

Figure 5:
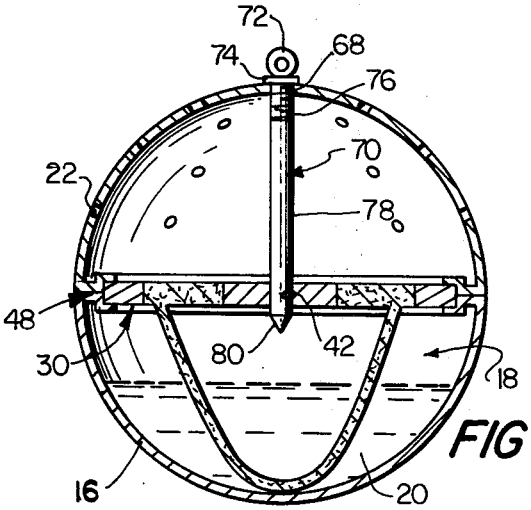
FIG. 5 is a side elevational view in longitudinal section of an article of jewelry in accordance with another embodiment of the present invention.

FIG. 5 illustrates an alternative embodiment to the construction of FIG. 1. In this embodiment, a different construction is provided to enable refilling of the reservoir 18. The features of the embodiments of FIGS. 1 and 5 which are similar are identified with identical reference numbers.

In this embodiment, the disc 30 is similar to that discussed regarding FIGS. 1 and 2 except there is no absorbent material 44 located in the central aperture 42, thereby leaving it unobstructed.

The central orifice 68 is threaded and is axially aligned with the central aperture 42 in the disc 30. Detachedly mounted with the central orifice 68 is a rod 70.

The rod 70 has a ring 72 fixedly secured at its upper end to enable the article 10 to be supported on such objects as chains, earring clamps and pins. Below the ring 72, the rod has an annular stop member 74. Threads 76 are formed on the rod 70 immediately below the stop member 74. A cylindrical shank 78 is provided below the threads 76 and has a cross-sectional diameter substantially equal to the cross-sectional diameter of the central aperture 42. When the rod 70 is assembled in the article of jewelry 10, a portion of the shank 78 mates with the central aperture 42 in an interference fit so as to seal the reservoir 18 at the central aperture 42. The lower end 80 of the shank 78 is pointed or tapered to facilitate insertion of the rod 70 into the central aperture 42. Since the cross-sectional diameter of the stop member 74 is greater than that of the central orifice 68, the extent to which the rod 70 may be inserted into central orifice 68 is limited to prevent over insertion.

To fill the reservoir 18 of this embodiment, the rod 70 is unthreaded from the central orifice 68 and completely removed from the article of jewelry 10. An eyedropper containing liquid perfume may then be inserted through the central orifice 68, through the internal volume of the upper hemisphere 14, and into and through the central aperture 42. Once the open end of the eyedropper is through the central aperture 42, perfume may be forced from the eyedropper and into the reservoir 18 until the level of perfume therein is just below the disc 30. After the reservoir 18 has been filled with liquid perfume 20, the rod 70 is then remounted within the central orifice 68 and the central aperture 42 to close and seal the reservoir 18.

This embodiment is advantageous in that it replaces the hypodermic needle necessary for the embodiment of FIG. 1 with an eyedropper. This replacement is particularly important where such needles are either illegal or difficult to obtain.

EMBODIMENT OF FIG. 6

Figure 6:
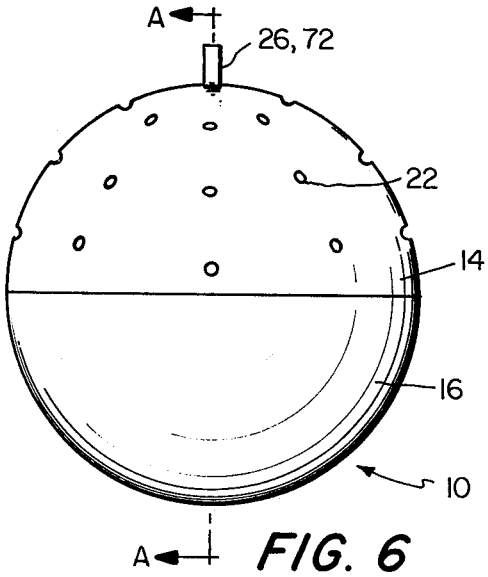

FIG. 6 illustrates the external configuration of an article of jewelry 10 according to the present invention and is generally generic to the embodiments discussed hereinabove. Lines A—A illustrate the plane used for sectioning FIGS. 1 and 5.

While various embodiments have been chosen to illustrate the invention, it will be understood by those skilled in this art that various changes and modifications can be made therein without departing from the scope of the invention as defined in the appended claims. For example, the article of jewelry 10 may be formed in any of a variety of shapes, e.g., cube, rectangular solid, pear-shaped, etc. Also, the disc support flanges 52, 54, 64, 66 may be formed as separate members which are securely and fixedly attached to the hemispherical members 14, 16 rather than being formed as unitary parts thereof.

What is claimed is:

1. An article of jewelry for dispensing perfumed vapors, the combination comprising:
   - a hollow housing having upper and lower portions coupled together to form said housing, said lower portion forming a reservoir for containing a quantity of perfume;
   - coupling means attached to said housing for coupling the jewelry to another object;
   - a central disc located inside said housing;
   - support means for supporting said disc in said housing;
   - a plurality of orifices located in said housing upper portion through which perfumed vapors may exit;
   - a central orifice located in said housing upper portion through which perfume may be introduced into said housing;
   - said disc having a plurality of cutouts, each said cutout being filled with absorbent material; and
   - wick means extending from said absorbent material into said lower portion.

2. An article of jewelry according to claim 1, wherein said absorbent material is gauze.

3. An article of jewelry according to claim 1, wherein said coupling means comprises a ring having an aperture formed therein, which aperture is aligned with said central orifice.

4. An article of jewelry according to claim 1, wherein said disc has a central aperture aligned with said housing central orifice and filled with absorbent material.

5. An article of jewelry according to claim 1, wherein said support means includes two inwardly extending flanges, one of said flanges is fixedly mounted on each said housing portion, said flanges being spaced part a distance sufficient to entrap said disc therebetween when said housing portions are coupled together.

6. An article of jewelry according to claim 5, wherein said flanges are formed from bent portions of adjacent edges of said housing portions.

7. An article of jewelry according to claim 1, wherein said housing portions are separately formed members which are attached by welding to form said hollow housing.

8. An article of jewelry according to claim 1, wherein said coupling means includes a rod having a ring at its upper end, a threaded portion below said ring and a tapered portion at its lower end; said housing central orifice is threaded to receive said threaded portion on said threaded rod.

9. An article of jewelry according to claim 8, wherein said disc has a central aperture, a portion of said rod is removably received in said central aperture to close same.

10. An article of jewelry according to claim 1, wherein said housing portions are coupled by a threaded connection.

* * * * *